United States Patent [19]

Afshar

[11] Patent Number: 4,744,178

[45] Date of Patent: May 17, 1988

[54] GRINDING DEVICE

[75] Inventor: Mohammad Afshar, Dublin, Ireland

[73] Assignee: Institute for Industrial Research and Standards, Dublin, Ireland

[21] Appl. No.: 911,326

[22] Filed: Sep. 25, 1986

[51] Int. Cl.[4] ..... B24B 19/00

[52] U.S. Cl. ..... 51/241 G; 51/219 R; 51/173

[58] Field of Search ..... 51/219 R, 289 R, 181 R, 51/241 G, 173

[56] References Cited

U.S. PATENT DOCUMENTS

| | | | |
|---|---|---|---|
| 1,052,073 | 2/1913 | Mallory | 51/219 R |
| 1,524,672 | 2/1925 | Rabut . | |
| 2,080,515 | 5/1937 | Tautz . | |
| 2,295,265 | 9/1942 | Morris . | |
| 2,663,126 | 12/1953 | Amlet . | |
| 2,848,852 | 8/1958 | Rosholt | 51/219 R |
| 3,060,645 | 10/1962 | Waggoner . | |
| 3,067,551 | 12/1962 | Maginnis | 51/289 R |
| 3,197,924 | 8/1965 | Mitchell | 51/219 R |
| 3,341,981 | 9/1967 | Baronyak | 51/219 R |
| 3,373,530 | 3/1968 | Cooprider | 51/219 R |
| 3,698,140 | 10/1972 | Steadman | 51/219 R |
| 3,703,055 | 11/1972 | Niquet | 51/219 R |
| 4,031,672 | 6/1977 | Moores et al. . | |
| 4,164,100 | 8/1979 | Wolff . | |
| 4,338,748 | 7/1982 | Elbel | 51/181 R |
| 4,411,105 | 10/1983 | Raiha . | |

FOREIGN PATENT DOCUMENTS

| | | |
|---|---|---|
| 450841 | 10/1927 | Fed. Rep. of Germany . |
| 2456173 | 8/1976 | Fed. Rep. of Germany . |
| 2285959 | 4/1976 | France . |
| 2358240 | 2/1978 | France . |
| 1468327 | 3/1977 | United Kingdom . |
| 1526169 | 9/1978 | United Kingdom . |

*Primary Examiner*—Harold D. Whitehead
*Attorney, Agent, or Firm*—Holman & Stern

[57] ABSTRACT

A hand held grinding device for sharpening drill bits comprises a pair of bearing members which rotatably support a grinding wheel fast on a shaft. Portion of the shaft is engagable with the chuck of a drill. A guide plate with grooves for various size ranges of drill bits is hingedly connected to the bearing members by a plastics hinge. The grooves direct the drill bit to the grinding wheel at an angle of 59°. By pivoting the guide plate relative to the bearing members, the trailing portion of the cutting edge of the drill bit is relieved.

11 Claims, 7 Drawing Sheets

GRINDING DEVICE

FIELD OF THE INVENTION

The present invention relates to a grinding device for grinding a tool or other article, and in particular though not limited to, a hand held device for sharpening a drill bit, either a steel or a masonry bit, or the like, the grinding device being of the type comprising a body member, a grinding wheel rotatably mounted in the body member, and guide means to direct the tool to the grinding wheel.

PRIOR ART

The life of a drill bit in general depends on the material in the drill bit, and the degree to which it has been hardened. One problem with drill bits is that in general, once they become dull they are thrown away. This is a considerable waste, as if the tip of the bit could be easily sharpened, one could obtain many times the life that can be achieved at present. Devices for sharpening drill bits are known, however, where it is desired to sharpen a bit with a relatively good degree of accuracy, it is necessary to use a special purpose machine tool. This, needless to say, is relatively expensive. Hand held grinding devices for attaching to a powered drill are generally not satisfactory.

Examples of such hand held devices are disclosed in U.S. Pat. Nos. 2,848,852 and 33,067,550, and British Patent Specification No. 1468327. These devices essentially comprise a body member and a grinding wheel rotatable in the body member. A guide means connected to the body member directs the drill bit at a desired angle, to a grinding wheel. However, in general these devices suffer from the disadvantage that the accuracy with which the drill bit tip can be ground is limited, and also they require two operations in order to grind the drill bit.

For example, British Patent Specification No. 1468327 discloses a device which comprises guide means which direct the drill bit onto the grinding wheel. The guide means comprises a pair of grooves at different angles to the grinding wheel. The bit is placed in one groove initially to sharpen the cutting edge, and then in the second groove to relieve the portion of the bit behind the cutting edge. It will be appreciated that this is relatively inconvenient in that it requires two operations in order to sharpen the drill bit. And furthermore, and more importantly, unless extreme care is taken in setting up the bit in the second groove when the trailing portion is being relieved, the relieved portion invariably will be incorrect. It may be too far back from the cutting edge or it may actually damage the cutting edge already ground. In both cases the drill will be useless. This problem is caused by the fact that the bit has to be moved between grinding the cutting edge and the relieved portion.

In U.S. Pat. No. 3,067,550, a device also for mounting to an electrically powered drill is provided for sharpening drill bits. In this device, the drill bits are directed by a guide means onto an end face of the grinding wheel. The guide means in this case comprises a drill holder which has a pair of pivot shafts, and to fully sharpen a drill bit the holder has to be moved so that one cutting edge is sharpened using one pivot shaft, and the second cutting edge is sharpened using the second pivot shaft. Further, it is questionable whether this device would adequately relieve the portion of the drill bit behind the cutting edge.

U.S. Pat. No. 2,848,852, also discloses a device for sharpening a drill bit for mounting in an electrically powered drill. Essentially, this device comprises a guide means which directs the drill bit to the end face of the grinding wheel. The guide means comprises a channel which is angled to offer the drill bit to the end face at the required angle. Again, this device suffers from substantially similar problems to that of U.S. Pat. No. 3,067,550, in that it is questionable whether it would adequately relieve the portion of the bit behind the cutting edge.

OBJECTS OF THE INVENTION

The object of the invention is to provide a grinding device for drill bits, and indeed other tools, which can accurately grind the drill bit tip in a single operation.

SUMMARY OF THE INVENTION

According to the present invention there is provided a grinding device for grinding a tool or other article, the device comprising a body member, a grinding wheel having a peripheral grinding surface, the grinding wheel being rotatably mounted in the body member for rotation about a rotational axis, and guide means to direct a tool to the grinding wheel, the guide means being pivotably mounted to the body member for pivotal movement about a pivot axis, the pivot axis between the guide means and the body member being spaced-apart from and substantially parallel to the rotational axis of the grinding wheel.

In one embodiment of the invention the pivot axis between the guide means and the body member substantially coincides with the peripheral grinding surface of the grinding wheel.

In a preferred embodiment of the invention the device includes stop means to limit the pivot angle between the guide means and the body member. Preferably the stop means comprises a spud projecting upwardly from the guide means to abut the body member, the spud being so dimensioned and positioned to permit approximately 15° of pivotal movement between the guide means and the body members.

In a preferred embodiment of the invention the guide means includes means for receiving a drill bit.

The means for receiving a drill bit may direct the bit to the peripheral grinding surface of the grinding wheel. Alternatively the means for receiving a drill bit may direct the drill bit to an end face of the grinding wheel.

In another embodiment of the invention the guide means comprises a plate member having an elongated groove defining the means for receiving the drill bit, the groove being disposed in the plate member so that the angle between the axis of the groove and the rotational axis of the grinding wheel is approximately half the included angle of the tip of the drill bit, and the groove supports the drill bit so that the axis of the drill bit is substantially in the same plane as the rotational axis of the grinding wheel, or in a plane just slightly below the plane of the rotational axis of the grinding wheel.

The guide plate member may include a plurality of grooves side by side with each other, the grooves being of different widths and/or depths to accommodate different sizes of drill bits, each groove supporting a drill bit so that portion of the drill bit sits proud of the guide plate member for engagement by a thumb or finger of a user to retain the bit in the groove.

In a preferred embodiment of the invention a shaft is rotatably mounted in the body member and the grinding wheel is fast on the shaft, the shaft having a free end projecting beyond the body member for connection to a chuck of a hand or powered drill.

Preferably the body member and the guide means are of plastics material and are integrally formed together, and wherein a plastics hinge is provided for pivotally connecting the guide means and the body member, the plastics hinge being integrally formed with the body member and guide means.

In one embodiment of the invention the grinding wheel is a compound wheel having a central core of one grinding material surrounded by a peripheral portion of a second grinding material, the core material being selected for grinding bits directed to the end face of the grinding wheel, and the peripheral portion being selected for grinding drill bits directed to the peripheral portions of the grinding wheel.

ADVANTAGES OF THE INVENTION

The advantages of the invention are many, however, by virtue of the fact that the guide means is pivotal along an axis spaced-apart from and substantially parallel to the rotational axis of the grinding wheel, by merely pivoting the guide means relative to the body member or vice-versa, after the cutting edge of the drill bit has been sharpened, the portion behind the cutting edge can readily easily be relieved without the need for transferring or moving the drill bit between the two operations. Furthermore, by virtue of the fact that the cutting edge is sharpened and relieved without the need to move the drill bit, more accuracy is achieved.

The advantage of the feature of the pivot axis between the guide means and the body member substantially coinciding with the peripheral grinding surface of the wheel is that it further increases the accuracy with which the relieved portion can be ground relative to the cutting edge.

The advantage of providing a stop means is that the degree to which the portion of the drill bit is relieved is controlled. Furthermore, the provision of stop means has the added advantage that it prevents the drill bit from slipping out between the guide means and the grinding wheel.

The advantage of the feature of the guide means directing the drill bit to the peripheral grinding surface of the grinding wheel is the device is ideally suited for sharpening drill bits.

The advantage of directing the drill bit to the end face of the grinding wheel is the device is ideally suited for sharpening masonry bits.

The advantage of the feature of the guide means comprising a grooved plate member is that a relatively easily handleable and managed device is provided. It also provides a device which can be produced at a relatively low cost. Furthermore, another advantage of this feature of the invention is that it ensures that the angle of the cutting edge is accurately formed.

Advantageously, the groove supports the drill bit so that the axis of the drill bit is in substantially the same plane as the rotational axis of the grinding wheel, or in a plane just slightly below the plane of the rotational axis of the grinding wheel.

The advantage of supporting the drill bit so that its axis is in the same plane as that of the rotational axis of the grinding wheel is that it ensures that the cutting edge of the drill bit is presented to the grinding wheel in the plane of the rotational axis of the grinding wheel, or just below it. This is important if an accurately formed cutting edge is to be achieved.

By virtue of the fact that the drill bits when in the groove sit slightly proud of the guide plate member, they are readily easily held in position by placing the thumb or finger across the guide plate member. In addition, because a plurality of grooves of different depths and widths are provided, drill bits of different diameters may be sharpened using the same device.

The advantage of forming the device in plastics is that a relatively lightweight and easily handled and managed device is provided. Furthermore, the device may be produced readily easily and simply, and at a relatively low cost.

The advantage of providing a grinding wheel which is a compound wheel is that two materials are provided in the grinding wheel, one suitable for grinding for example a masonry drill bit, and the other suitable for grinding a steel drill bit.

These and other objects and advantages of the invention will be readily apparent from the following description of some non-limiting embodiments.

DETAILED DESCRIPTION OF THE INVENTION

Figure 1:
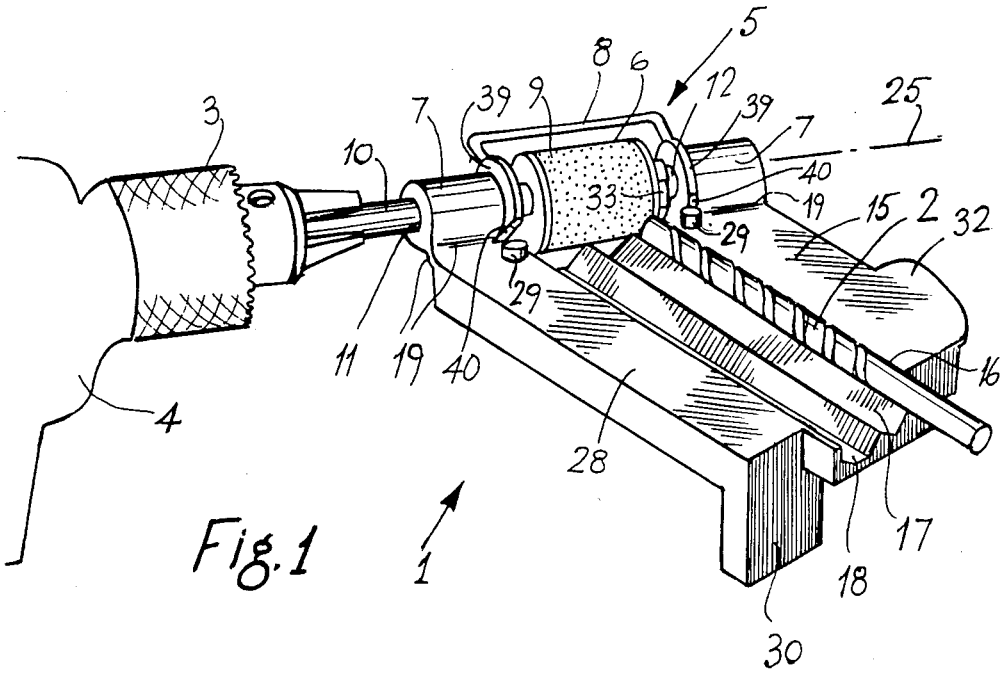
FIG. 1 is a perspective view of a grinding device according to the invention.
Figure 2:
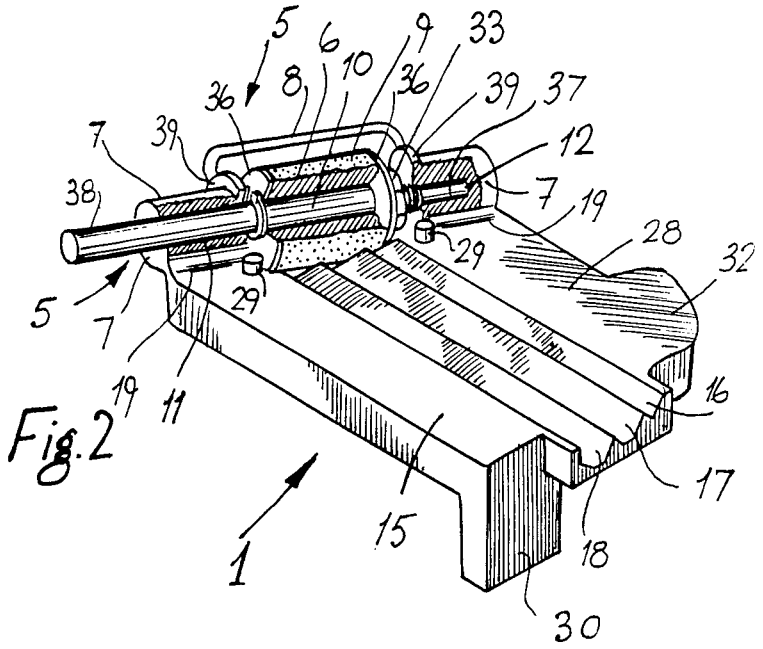
FIG. 2 is a partly cut-away perspective view of the device of FIG. 1.

Referring to the drawings, and initially to FIGS. 1 to 11, there is provided a grinding device according to the invention, indicated generally by the reference numeral 1 for grinding tools, in this case, a drill bit 2. The device 1 is particularly suitable for powering by an electrically powered hand drill 4, the chuck 3 of which is illustrated in FIG. 1. The device 1 comprises a body member 5 having a pair of bearing members 7 joined by a guard member 8, all of plastics material and integrally injection moulded. A grinding wheel 9 of aluminium oxide fast on a shaft 10 is rotatable in bearing holes 11 and 12 in the bearing members 7. A guide means to guide the drill bit 2 onto the peripheral grinding surface 6 of the grinding wheel 9 at a desired sharpening angle, is provided by a guide plate member 15 with three grooves 16, 17 and 18 to receive and guide the drill bits 2. The guide plate member 15 is of plastics material and is joined by a plastics hinge 19 to the bearing members 7. The bearing members 7,the plastics member 15 and the plastics hinge 19 are all integrally injection moulded. The grooves 16, 17 and 18 are set at an angle of 59° to the rotational axis 25 of the grinding wheel 9, and this ensures that the included angle of the cutting edges at the tip of the drill bit is 118°.

As can be seen, the grooves 16, 17 and 18 are of different depth and width so that each groove accommodates a different range of sizes of bits. The groove 16 is for a small range of sizes, namely, up to approximately 3 mm diameter bits. The groove 17 is for a medium size range of sizes up to approximately 6 mm in diameter, and the groove 18 is for a larger range of sizes above 6 mm diameter. The depth and width of each groove is such that whether the bit is supported on the side 22 or the base 23 of a groove, the center line 24 of the bit is substantially in the same plain as the rotational axis 25 of the grinding wheel, thus ensuring that the cutting edge of the drill bit approaches the peripheral grinding surface of the grinding wheel in substantially the same plain. This can be clearly seen in FIGS. 4, 10 and 11. This gives the most accurate cutting edge. Each groove 16, 17 and 18 is so sized that the cutting edge of the bit of the maximum diameter for that particular groove approaches the peripheral grinding surface of the grinding wheel in the common plane of the bit axis and the grinding wheel axis, and the smaller diameter bits for that particular groove engage the peripheral grinding surface of the grinding wheel just below the common plane.

Figure 4:
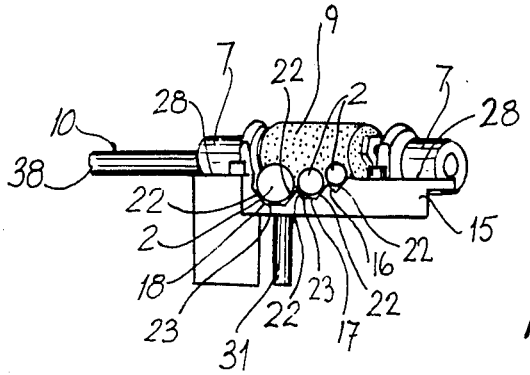
FIG. 4 is an end view of the device of FIG. 1.
Figure 7:
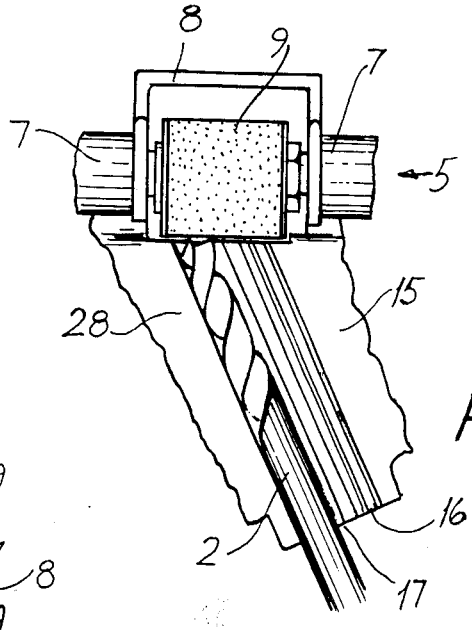
FIG. 7 is a plan view of a detail of the device of FIG. 1.

Furthermore, the grooves are also sized so that even the smallest bit size for a particular groove size when sitting in a groove, always sits slightly proud of the surface 28 of the guide plate 15, see FIG. 4. The advantage of this is that it allows a user to easily hold the bit being sharpened in the groove by merely placing his thumb or finger across the surface 28 of the guide plate 15, as illustrated in FIG. 6.

The plastic hinge 19 is formed by a relatively thin section of plastics material joining the guide plate 15 with the bearing members 7. Thus, the plastic hinge 19 forms a pivot axis 27 between the guide plate member 15 and the bearing members 7, which is substantially parallel and spaced-apart from the rotational axis of the grinding wheel 9. In this particular case, the pivot axis 27 substantially coincides with the peripheral grinding surface 6 of the grinding wheel 9. This permits the guide plate member 15 to be pivoted relative to the bearing members 7, and in turn the grinding wheel 9, and by pivoting the guide plate 15 in the direction of the arrow A of FIG. 6, the trailing portion of the drill behind the cutting edge is relieved. This has a particular advantage in that the tip can be relieved without the need for moving the drill bit after sharpening the cutting edge. Thus, there is no danger of any damage to the cutting edge during the relieving operation.

Figure 9:
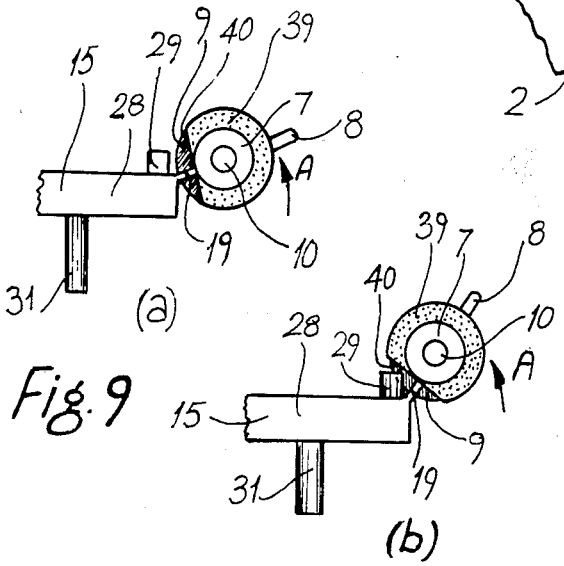
FIGS. 9(*a*) and (*b*) are side views of a detail of the device of FIG. 1.
Figure 10:
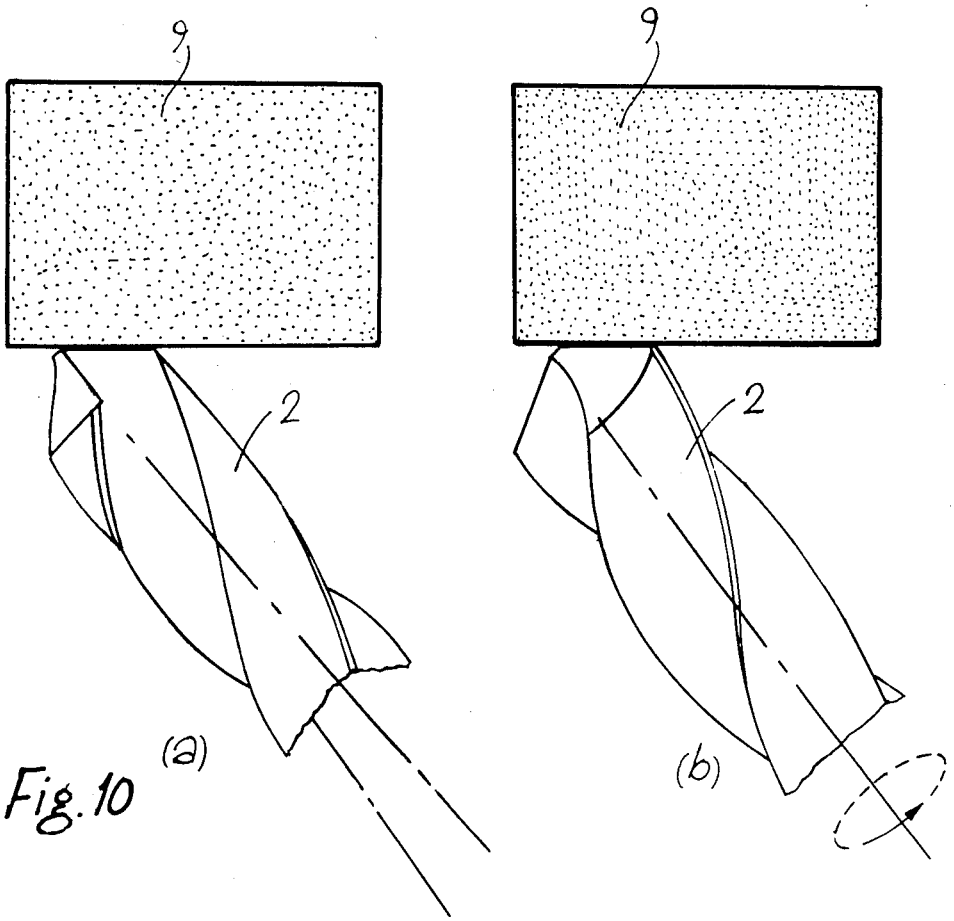
FIGS. 10 (*a*) and (*b*) are enlarged views of a detail of the device of FIG. 1 in use.
Figure 11:
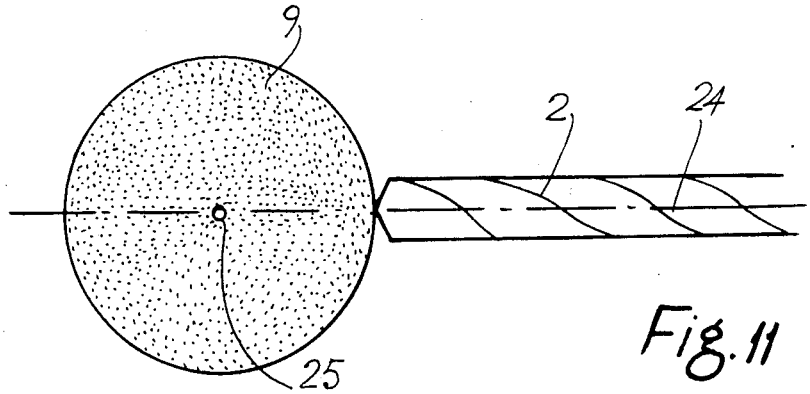
FIG. 11 is a diagrammatic end view of the device of FIG. 1 in use.
Figure 12:
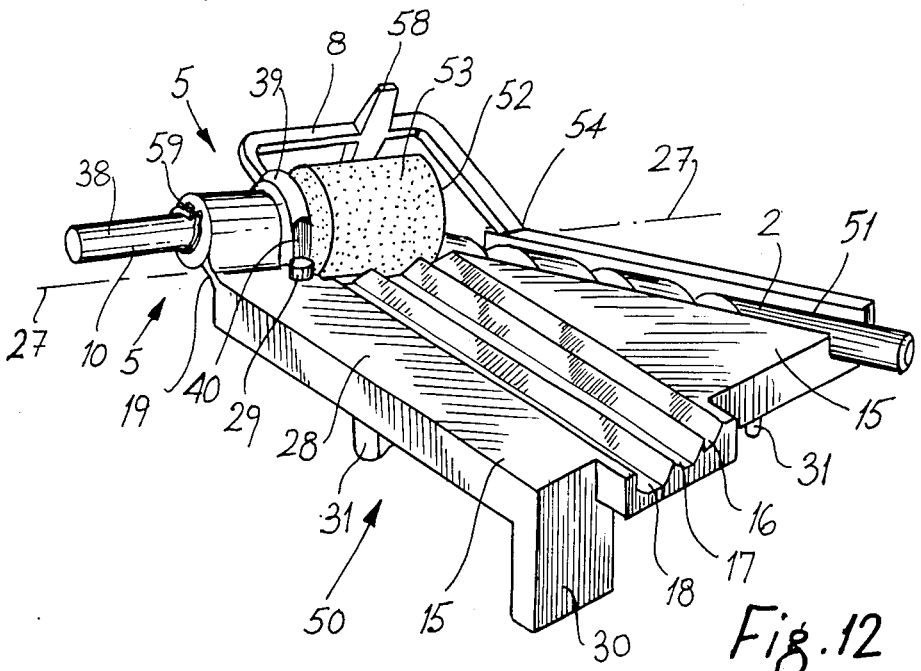
FIG. 12 is a perspective view of a device according to another embodiment of the invention.
Figure 13:
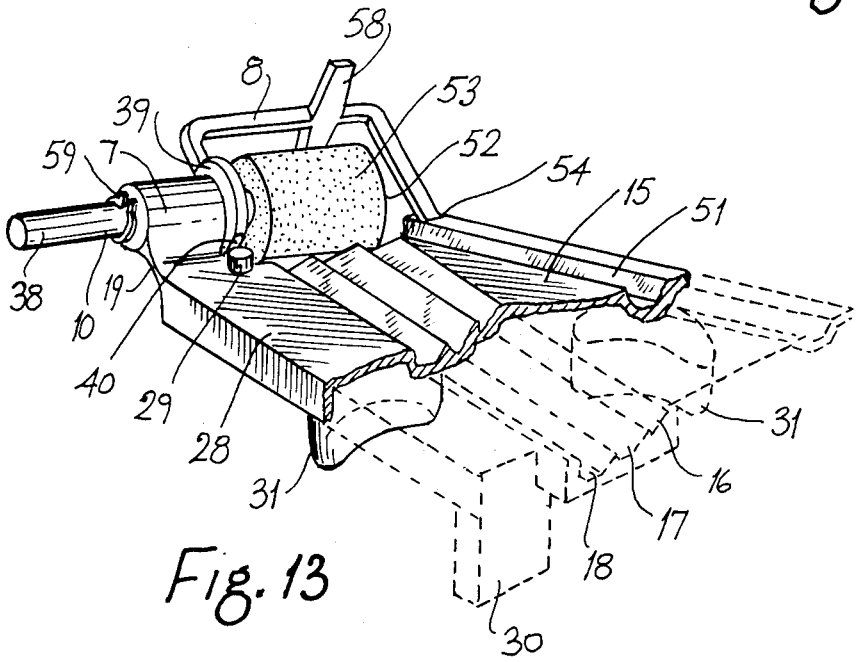
FIG. 13 is a partly cut-away perspective view of the device of FIG. 12.
Figure 14:
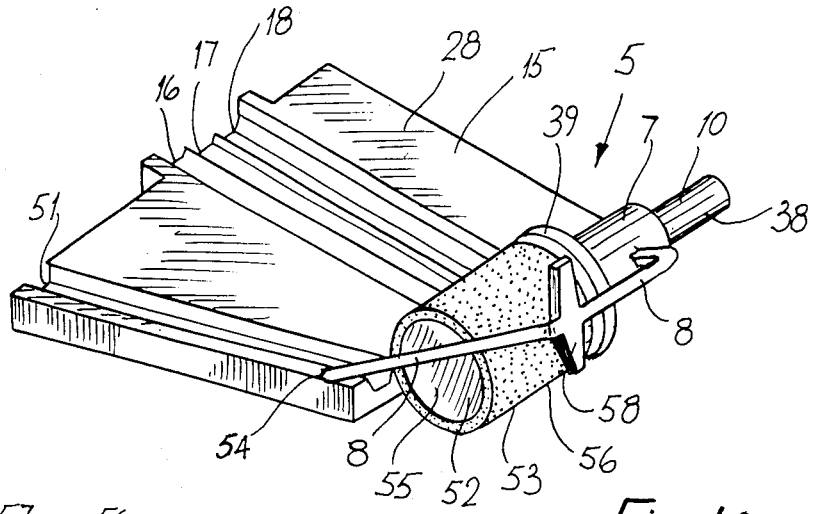
FIG. 14 is a perspective view of the device of FIG. 12.
Figure 16:
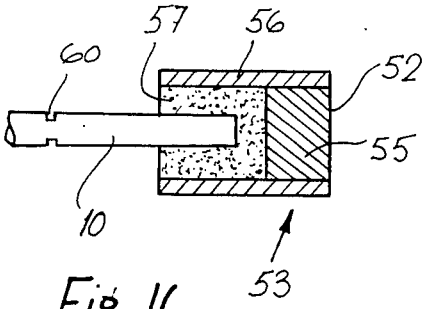
FIG. 16 is a partly sectional view of a detail of the device of FIG. 12.
Figure 15:
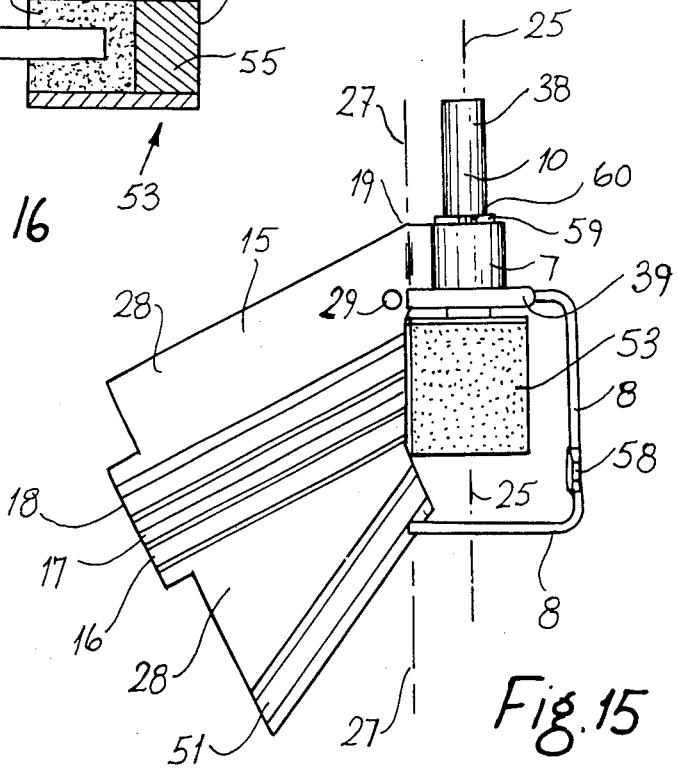
FIG. 15 is a plan view of the device of FIG. 12.

Stop means provided by a pair of spuds 29 extending upwardly from the guide plate member 15 abut the bearing members 7 to restrict the pivot angle through which the guide plate 15 may be pivoted relative to the bearing members 7, see FIGS. 9(*a*) and (*b*). In this case, the pivot angle is restricted to 15°. This avoids any possibility of overrelieving the tip of the drill bit, and also prevents smaller diameter drills from passing between the guide plate 15 and the grinding wheel 9.

Figure 5:
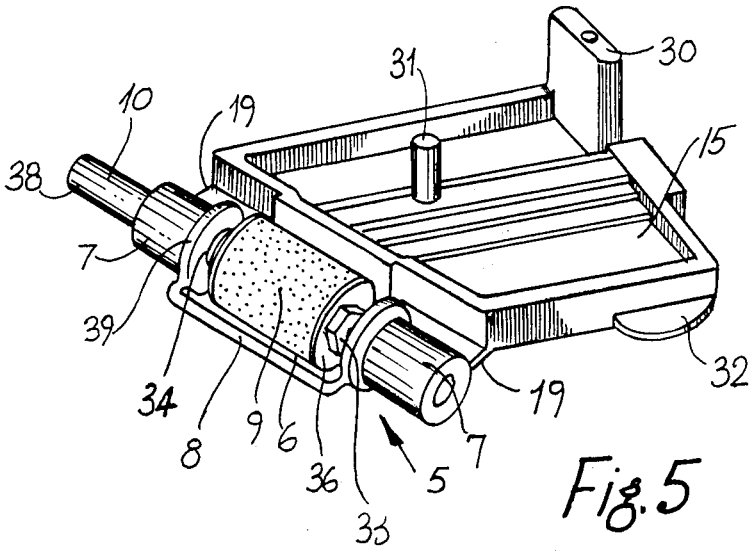
FIG. 5 is an upside down perspective view of the device of FIG. 1.
Figure 3:
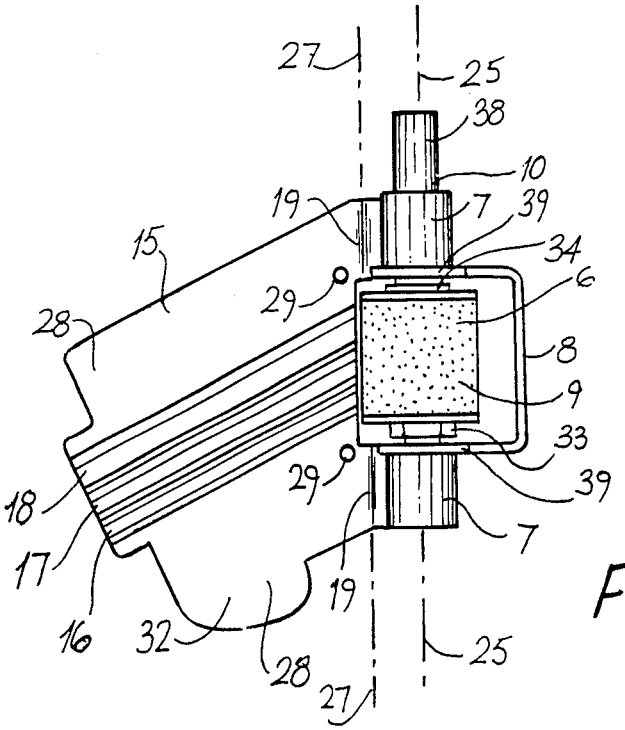
FIG. 3 is a plan view of the device of FIG. 1.
Figure 6:
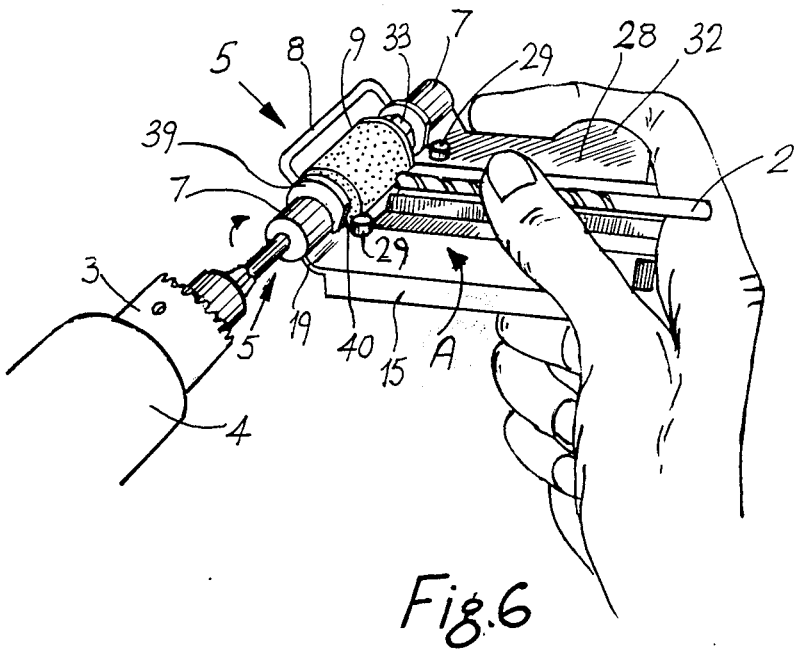
FIG. 6 is a perspective view of the device of FIG. 1 in use.

Projecting portions 30 and 31 permit the device to be gripped by the user's fingers, as illustrated in FIGS. 5 and 6. A portion 32 permits the device to be rested on the index finger in use.

Figure 8:
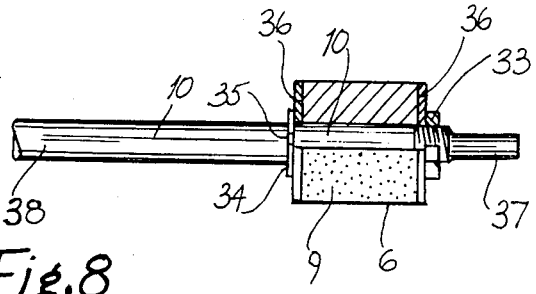
FIG. 8 is a partly sectional view of a detail of the device of FIG. 1.

Referring to FIG. 8, the grinding wheel 9 is retained fast on the shaft 10 between a nut 33 and a circlip 34 which engages a groove 35 on the shaft 10. Washers 36 are provided at each end of the grinding wheel 9. The end 37 of the shaft 10 which engages the bearing hole 12 is stepped down to accommodate the nut 14. An end portion 38 of the shaft 10 extends beyond one of the bearing members 7 for engagement with the chuck 3 of the electrically powered hand drill 4, or indeed any other power tool.

Flanges 39 are provided on the bearing members 7 adjacent the grinding wheel 9 to protect the grinding wheel 9. As can be seen, the diameter of the flanges 39 is slightly greater than that of the grinding wheel. The guard member 8 which extends between the flanges 39 further protects the grinding wheel 9 in the event of it falling. Portions 40 of the flanges 39 are relieved to accommodate the stop spuds 29 thus permitting relative pivoting of the bearing members 9 and the guide plate member 15.

In use, the grinding device 1 is mounted in an electrically powered hand drill with the portion 38 of the shaft 10 engaged in the chuck 3 of the drill. The bit 2 to be sharpened is placed in the appropriate groove 16, 17 or 18, and retained by the thumb, see FIG. 6. Once the grinding wheel is rotating, the bit 2 is fed along the groove so that its tip and cutting edge bears on the peripheral surface 6 of the grinding wheel 9. When the cutting edge has been adequately sharpened, the guide plate member 15 of the device is pivoted upwardly along the plastic hinge 19 in the direction of the arrow A to relieve the trailing portion of the cutting edge. Before the plate member 15 is returned to its original position, the bit is withdrawn from the grinding wheel. The bit is then rotated through 180°, and the other cutting edge of the tip is sharpened and relieved in a similar fashion.

Referring now to FIGS. 12 to 16, there is illustrated a grinding device 50 according to another embodiment of the invention. This device is substantially similar to that described with reference to FIGS. 1 to 11, and similar components are identified by the same reference numeral. The main difference between this device 50 and the device 1 just described, is that an additional guide groove 51 is provided in the guide plate member 15 for directing a bit to the end face 52 of a grinding wheel 53. The groove 51 is substantially similar to the grooves 16, 17 and 18, and directs the bit, in this case, a masonry bit 2, to the end face 52 at an angle of 20° to the rotational axis of the grinding wheel 53. To accommodate the masonry bit 2, one of the bearing members 7 is removed and the guard member 8 in this case extends around to the guide plate member 15 where it is joined by a plastic hinge 54. As can be seen, the axis of the plastic hinge 54 and the plastic hinge 19 coincide. Projections 58 are provided in the guard member 8 to further protect the grinding wheel in the event of it falling.

In this case, the grinding wheel 53 is a compound grinding wheel, having an inner core 55 of silicone carbide for grinding the masonry bit, and an outer peripheral portion 56 for grinding steel bits. The shaft 10 projects into the grinding wheel 53, and is secured coaxially with the wheel by a filler adhesive 57. The grinding wheel 53 and shaft 10 are retained in the bearing member 7 by a circlip 59 engaging a groove 60 on the shaft 10. A washer (not illustrated) may be provided on the shaft 10 between the grinding wheel 53 and the bearing member 7.

The use of this device is substantially similar to that already described, however, when it is desired to sharpen a masonry bit, the bit is fed in the groove 51 so that the tip bears on the end face 52 of the grinding wheel 53. Once the first cutting edge of the masonry bit is sharpened, the bit is then rotated to sharpen the other cutting edge.

It will be appreciated that while the bearing members and the guide plate member of the device have been described as being formed integrally of injection moulded plastics material, any other suitable material could be used. In fact, where plastics material is used, it is not necessary that it be injection moulded, and furthermore, it is not necessary that it be integrally formed. They could be formed separately and hinged or pivoted together in any other suitable fashion.

Furthermore, it will be appreciated that while grinding wheels of particular materials have been described, any other suitable materials could be used. Needless to say, it will be appreciated in the second embodiment of the invention, that while preferable, it is not necessary that the grinding wheel be formed from two different materials.

It will also of course be appreciated that any other suitable means of mounting the grinding wheel on the shaft in both embodiments of the invention could be used.

Furthermore, it is envisaged that guide means besides a plate member with grooves could be used. All that is really necessary is two means which engage the drill bit at two spaced-apart positions, to guide it at the desired angle to the grinding wheel. It will also of course be appreciated that while particular angles have been described, the grooves could direct the drill bit at any other desired angles.

Furthermore, it will be appreciated that while in both embodiments of the invention three grooves have been illustrated to accommodate three different sizes of drill bits, more or less grooves could be provided. In fact, in its simplest, one groove only may be provided. It will also of course be appreciated that while only one groove has been described for accommodating the masonry bit in the second embodiment of the invention, more than one groove if desired could be provided, and of course, it will be appreciated that in certain cases other means for guiding masonry bits besides the groove could be provided.

It will also of course be appreciated that while flanges and guard members have been described for protecting the grinding stone, while these are preferable they are not necessary, and furthermore, it is envisaged that other suitable protecting means if these should be desired, may be provided. It will also be appreciated that stop means other than a pair of spuds abutting the bearing members, could be provided. Such other stop means would be readily apparent to those skilled in the art. It will also of course be appreciated the grip means other than those described could similarly be provided.

Furthermore, while the grinding device has been described for mounting to the chuck of an electric drill, it could be adapted for mounting to any other driving means, for example, a hand drill, a chuck of a lathe, or indeed any other driving shaft.

Furthermore, while the grinding device has been described for sharpening steel bits and masonry drill bits, it could be used for any other drill bits. And furthermore, it will be appreciated that the device could be used for sharpening any other tools besides drill bits. It is envisaged that where the device is used for sharpening other tools, appropriate guide means will be provided at appropriate angles. Indeed, it is envisaged that in certain cases the angle of the guide means may be movable relative to the grinding wheel, for example, it is envisaged that grooves formed in a plate member could be pivotally mounted on a second plate member, for example, the guide plate member 15, so that by pivoting the plate member with the grooves relative to the guide plate member, the angle at which the tools would be directed to the grinding wheel, could be varied.

Needless to say, it is envisaged that other shapes of guide plate member and body member and bearing members could be provided. Indeed, where the device is of metal, it is envisaged that the body member may be formed by bending sheet metal to form a pair of or a single bearing member, a guide plate could then be pivotally connected to projecting portions of sheet metal from the bearing member or members, thus spacing the pivot axis from the grinding wheel axis.

Additionally, it will be appreciated that while the hinge axis, in other words, the pivot axis between the guide plate member and the body member has been described as coinciding with the peripheral grinding surface of the grinding wheel, while this is preferable it is not absolutely necessary, the hinge axis could be offset from the peripheral grinding surface of the grinding wheel. It is, however, important that the hinge axis should be substantially parallel to the rotational axis of the grinding wheel.

Furthermore, it is envisaged that while the stop means has been described as permitting a pivot angle of 15° this is not necessary, the pivot angle permitted could be greater or lesser. Indeed, in certain cases the stop means may be dispensed with.

It is also envisaged that while the angle of the groove 51 for masonry bits has been described as 20° this could be varied by plus or minus 10° and needless to say, could in certain cases be any other suitable angle.

What is claimed is:

1. A hand-held grinding device for grinding a drill bit or other tool, the device comprising:

a grinding wheel supporting body member, a shaft rotatably mounted in the supporting body member for rotation about a rotational axis, the shaft having a free end for attachment to a chuck, a grinding wheel mounted on the shaft and having a peripheral grinding surface, a tool guide member having a groove means to receive and direct a tool for the grinding wheel, the guide member being configured for gripping in one hand with a user's thumb holding a tool in the guide means, the tool guide member being pivotally mounted to the grinding wheel supporting body member for pivotal movement about a pivot axis, the pivot axis between the tool guide member and the grinding wheel supporting body member being spaced apart from and substantially parallel to the rotational axis of the grinding wheel.

2. A grinding device as claimed in claim 1 wherein the pivot axis between the tool guide member and the grinding wheel supporting body member substantially coincides with the peripheral grinding surface of the grinding wheel.

3. A grinding device as claimed in claim 1 wherein the device include a stop means to limit the pivot angle between the tool guide member and the grinding wheel supporting body member.

4. A grinding device as claimed in claim 3 wherein the stop means comprises a spud projecting upwardly from the guide member to abut the grinding wheel supporting body member, the spud being so dimensioned and positioned to permit approximately 15° of pivotal movement between the guide member and the grinding wheel supporting body member.

5. A grinding device as claimed in claim 1 wherein the guide member includes means for receiving a drill bit.

6. A grinding device as claimed in claim 5 wherein the means for receiving a drill bit directs the drill bit to the peripheral grinding surface of the grinding wheel.

7. A grinding device as claimed in claim 5 wherein the means for receiving a drill bit directs the drill bit to an end face of the grinding wheel.

8. A grinding device as claimed in claim 5 wherein the tool guide member comprises a plate member having an elongated groove defining the means for receiving the drill bit, the groove being disposed in the plate member so that the angle between the axis of the groove and the rotational axis of the grinding wheel is approximately half the included angle of the tip of the drill bit, and the groove supports the drill bit so that the axis of the drill bit is substantially in the same plane as the rotational axis of the grinding wheel, or in a plane just slightly below the plane of the rotational axis of the grinding wheel.

9. A grinding device as claimed in claim 8 wherein the guide plate member includes a plurality of grooves side by side with each other, the grooves being of different widths and/or depths to accommodate different sizes of drill bits, each groove supporting a drill bit so that portion of the drill bit sits proud of the guide plate member for engagement by a thumb or finger of a user to retain the bit in the groove.

10. A grinding device as claimed in claim 1 wherein the grinding wheel supporting body member and the tool guide member are of plastics material and are integrally formed together, and wherein a plastics hinge is provided for pivotally connecting the tool guide member and the grinding wheel supporting body member, the plastics hinge being integrally formed with the grinding wheel supporting body member and the tool guide member.

11. A grinding device as claimed in claim 1 wherein the grinding wheel is a compound wheel having a central core of one grinding material surrounded by a peripheral portion of a second grinding material, the core material being selected for grinding bits directed to the end face of the grinding wheel, and the peripheral portion being selected for grinding drill bits directed to the peripheral portion of the grinding wheel.

* * * * *